United States Patent [19]

Schönfeld et al.

[11] 4,031,738

[45] June 28, 1977

[54] PLUG FOR PLUG ROLLING

[75] Inventors: Wolfram Schönfeld, Meerbusch-Osterrath; Armin Philipps; Fritz Runkel, both of Dusseldorf, all of Germany

[73] Assignee: Mannesmannrohren-Werke AG., Mannesmann-Hochhaus, Germany

[22] Filed: Aug. 21, 1975

[21] Appl. No.: 606,367

[30] Foreign Application Priority Data

Aug. 22, 1974 Germany ..... 286649

[52] U.S. Cl. ..... 72/478; 72/97; 72/209

[51] Int. Cl.[2] ..... B21B 25/00

[58] Field of Search ..... 72/209, 97, 478

[56] References Cited

UNITED STATES PATENTS 3,762,201 10/1973 Schonfeld ..... 72/209

*Primary Examiner*—Milton S. Mehr

*Attorney, Agent, or Firm*—Ralf H. Siegemund

[57] ABSTRACT

The plug is assembled from three parts held against the mandrel by a tie rod which is screwed into the front and guiding part. A spacer is keyed to the latter part as well as to the tie rod, whereby tie rod keying is provided though flat surface portions interrupting the cylindrical surface portions of the spacer bore and the tie rod, while the guiding part and spacer are mutually keyed through axially aligned square portions and a clip thereon.

3 Claims, 2 Drawing Figures

PLUG FOR PLUG ROLLING

BACKGROUND OF THE INVENTION

The present invention relates to plugs in plug mills, and more particularly the invention relates to securing a multiple part plug to the mandrel.

The plug in a plug rolling mill is usually manually placed in position and secured to the mandrel. Some of the known plugs are constructed from multiple parts, which are to be interconnected. Specifically, plugs are known having a guiding part of element, an intermediate part or element and a working part of element, and these elements are resiliently biased to each other. The known plugs are rather difficult to assemble and to remove from the mandrel.

DESCRIPTION OF THE INVENTION

It is an object of the present invention to provide a new and improved plug assembly which is rather easily removable, but which will not disassemble as long as locked.

In accordance with the preferred embodiment of the present invention, it is suggested to improve a plug having a working plug element, an intermediate element and a guiding element, in the following manner. A tie rod is provided to be secured to the mandrel through a cone; the working and intermediate elements are traversed by the rod, whereby the former abuts the mandrel and the latter abuts a spacer ring which in turn abuts the guiding element; the working and intermediate elements are resiliently baised apart. The spacer and the guide elements are held against mutual angular displacement while the spacer is keyed to the tie rod; the latter being screwed into the guide element.

The spacer and guide element have preferably each square ends, which are axially aligned, and a clip engages both to prevent angular displacement between them. The tie rod and the bore in the spacer are preferably provided with mutually engaging, flat keying surfaces, so that the spacer cannot turn on the tie rod, and the clip prevents the guide element from unscrewing.

DESCRIPTION OF THE DRAWING

While the specification concludes with claims particularly pointing out and distinctly claiming the subject matter which is regarded as the invention, it is believed that the invention, the objects and features of the invention and further objects, features, and advantages thereof will be better understood from the following description taken in connection with the accompanying drawings in which:

Figure 2:
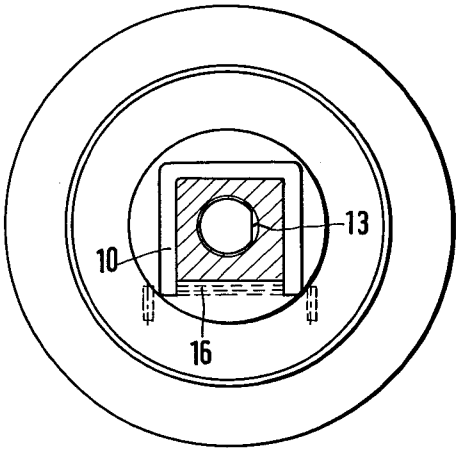
FIG. 2 is a cross-section along line A–B of FIG. 1.
Figure 1:
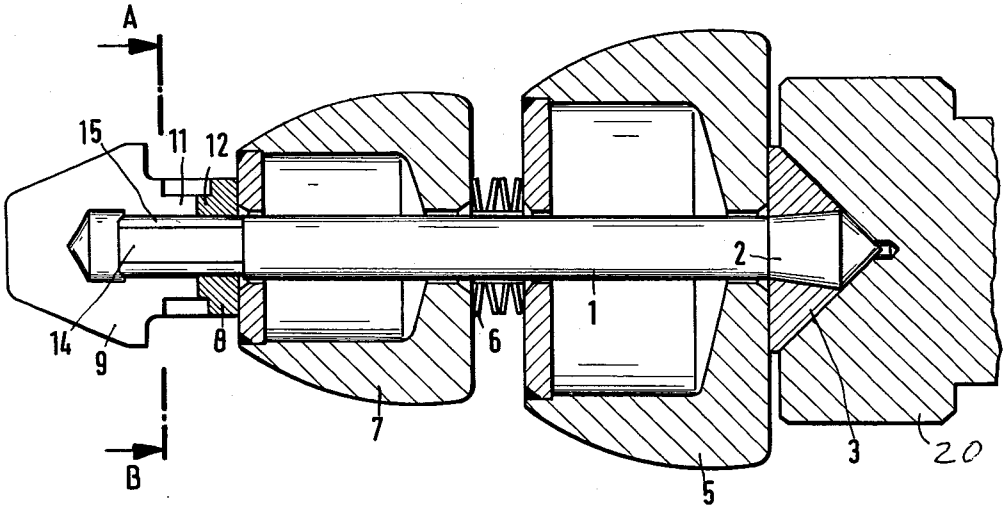
FIG. 1 is a longtudinal section view through a completely assembled plug.

Proceeding now to the detailed description of the drawing, the figures show a, basically three part plug, having parts or elements 5, 7 and 9 and being shown as connected to a mandrel 20. The main element that provides for the interconnection is a tension-tie-rod 1 having a conically flared portion 2 on one end by means of which it is connected to a thrust insert 3 for mandrel 20. The other end of rod 1 is screwed into plug element 9.

The working section or element 5 of the plug abuts axially to insert 3; otherwise plug element 5 has openings clearingly traversed by rod 1. Plug element 5 is forced against insert 3 by a spring 6, which in turn is acted upon by central or intermediate plug element 7. That intermediate element is likewise clearingly traversed by rod 1.

The front and guiding plug element 9 of the plug has a threaded bore into which is threaded the correspondingly threaded end of rod 1. A spacer ring 8 is interposed between and in abutment with both elements 7 and 9. the ring 8 is just slipped onto rod 1, over the threaded end portion thereof.

The plug element 9 has a square shaped key neck 11, and the spacer 8 has a similar neck 12. These necks are axially aligned, and a clip 10 engages them both to prevent angular displacement between spacer 8 and plug element 9. The ends of clip 10 are held together by a pin or bolt 16.

The spacer 8 has generally a cylindrical bore, but a flat internal surface 13 is provided to key with a corresponding flat portion 14 of rod 1. The mutual engagement of surfaces 13 and 14 prevents relative rotation of rod 1 in spacer 8, and clip 20 in turn prevents rotation (unscrewing) of rod 1 from guide element 9 of the plug assembly.

The plug is assembled as follows. First, insert 3 is slipped onto the tie rod from the threaded end towards the other end until held by and on cone 2. Next, element 5, spring 6 and element 7 are simply slipped onto rod 1 and in the stated sequence. Thereafter, spacer 8 is also slipped onto rod but in a keying disposition as far as surfaces 13 and 14 are concerned. Next, guide element 9 is screwed onto the rod 1, whereby the spring 6 is biased to urge the element 5 against insert 3. The square portions 11 and 12 are brought into axial alignment so that the clip 10 can arrest their angular position, and pin 16 is used to fasten the clip. For disassembling the procedure is reversed.

It can readily be seen that the plug can be relatively fast and simple assembled and removed, particularly for exchanging worn-out parts; still, the simple locking mechanism prevents undesired rotation and unscrewing from tie rod 1.

The invention is not limited to the embodiments described above, but all changes and modifications thereof not constituting departures from the spirit and scope of the invention are intended to be included.

We claim:

1. Plug for plug rolling mills to be connected to a mandrel and having a first plug element, being the primary working plug in abutment with the mandrel, an intermediate plug element, and a guiding plug element, the improvement comprising:

a tie rod threadedly received with one end by the guiding plug element and having a cone for connection to a mandrel insert on the other end, the first and intermediate plug elements being traversed by the tie rod;

resilient means interpositioned between the first and intermediate plug elements through which the latter urges the former against the mandrel insert;

a spacer interposed and in abutment with the intermediate and the guiding plug elements;

first means for preventing relative angular displacement between the guiding and the intermediate plug elements; and second means for preventing angular displacement of the guiding plug element relative to the tie rod, so that by operation of the first and second means the guiding element is prevented from unscrewing.

2. Plug as in claim 1, wherein the first means includes a square clip, the guiding and intermediate plug elements having axially alignable keying surfaces for engagement with said clip.

3. Plug as in claim 1, wherein the second means includes engaging keying surfaces of the tie rod and the spacer.

* * * * *